US007452650B2

(12) United States Patent
Bayley et al.

(10) Patent No.: US 7,452,650 B2
(45) Date of Patent: Nov. 18, 2008

(54) COATED CARRIERS AND PROCESSES THEREOF

(75) Inventors: Robert D. Bayley, Fairport, NY (US); Grazyna E. Kmiecik-Lawrynowicz, Fairport, NY (US); Maura A. Sweeney, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 645 days.

(21) Appl. No.: 11/043,340

(22) Filed: Jan. 26, 2005

(65) Prior Publication Data

US 2006/0166124 A1 Jul. 27, 2006

(51) Int. Cl.
*G03G 9/113* (2006.01)

(52) U.S. Cl. ..... 430/111.32; 430/111.1; 430/111.35; 430/137.13

(58) Field of Classification Search ..... 430/111.32, 430/111.35, 111.31, 111.3, 111.1, 137.13; 524/502

See application file for complete search history.

(56) References Cited

U.S. PATENT DOCUMENTS

| | | | | |
|---|---|---|---|---|
| 3,533,835 | A | 10/1970 | Hagenbach et al. | |
| 3,590,000 | A | 6/1971 | Palermiti et al. | |
| 3,658,500 | A | 4/1972 | Hagenbach | |
| 3,798,167 | A | 3/1974 | Kulka et al. | |
| 3,918,968 | A | 11/1975 | Kukla et al. | |
| 3,922,382 | A | 11/1975 | Kukla et al. | |
| 3,939,086 | A | 2/1976 | Hagenbach | |
| 4,233,387 | A | 11/1980 | Mammino et al. | |
| 4,238,558 | A | 12/1980 | Ziolo | |
| 4,264,697 | A | 4/1981 | Perez et al. | |
| 4,310,611 | A | 1/1982 | Miskinis | |
| 4,397,935 | A | 8/1983 | Ciccarelli et al. | |
| 4,434,220 | A | 2/1984 | Abbott et al. | |
| 4,935,326 | A | 6/1990 | Creatura et al. | |
| 4,937,166 | A | 6/1990 | Creatura et al. | |
| 5,529,719 | A * | 6/1996 | Cunningham et al. | 252/511 |
| 5,935,750 | A | 8/1999 | Barbetta et al. | |
| 5,945,244 | A | 8/1999 | Barbetta et al. | |
| 6,004,712 | A * | 12/1999 | Barbetta et al. | 430/111.35 |
| 6,010,812 | A | 1/2000 | Barbetta et al. | |
| 6,042,981 | A | 3/2000 | Barbetta et al. | |
| 2005/0031980 | A1 * | 2/2005 | Inoue et al. | 430/108.22 |

OTHER PUBLICATIONS

Neufeldt, V., et. al., ed., *Webster's New World Dictionary*, Third Colllege Edition, Simon & Schuster, Inc., NY (1988), p. 763.*

* cited by examiner

*Primary Examiner*—Janis L Dote
(74) *Attorney, Agent, or Firm*—Oliff & Berridge, PLC

(57) ABSTRACT

A carrier comprised of a core and a polymer generated from a mixture of two latexes, and wherein the first latex enables a polymer with a high molecular weight, and the second latex enables a polymer with a low molecular weight, and wherein high represents a weight average molecular weight of from about 1,000,000 to about 8,000,000, and said low represents a weight average molecular weight of from about 500,000 to about 750,000.

25 Claims, No Drawings

COATED CARRIERS AND PROCESSES THEREOF

RELATED PATENTS

Illustrated in U.S. Pat. No. 5,945,244; U.S. Pat. No. 6,042,981; U.S. Pat. No. 6,010,812; and U.S. Pat. No. 5,935,750, the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in there is illust U.S. Pat. No. 6,042,981 there is illustrated a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,010,812 there is illustrated a carrier comprised of a core and a polymer coating of (1) styrene/monoalkylaminoalkyl methacrylate or (2) styrene/dialkylaminoalkyl methacrylate; and in U.S. Pat. No. 5,935,750 there is illustrated a carrier comprised of a core and a polymer coating containing a quaternary ammonium salt functionality.

Disclosed in U.S. Pat. No. 6,004,712, the disclosure of which is totally incorporated herein by reference, is carrier comprised of a core and thereover a polymer of (1) methylmethacrylate and a monoalkyl aminoalkyl methacrylate, or (2) a polymer of methylmethacrylate and dialkylaminoalkyl methacrylate.

The appropriate components and processes of the above recited patents may be selected for the present invention in embodiments thereof.

BACKGROUND

This invention is generally directed to developer compositions, and more specifically, the present invention relates to developer compositions with coated carrier components, or coated carrier particles that can be prepared by, for example, the selection of two latexes, which are wet blended, followed by coating on a carrier core and drying. More specifically, the present invention relates to carrier compositions comprised of a core, and thereover a polymer, such as a polymer of polymethylmethacrylate co-methacrylic acid generated from two dissimilar latexes, that is latexes that contain the same monomer, and wherein there is generated a polymer with a high weight average molecular weight, such as from about 1,000,000 to about 8,000,000 and a polymer with a low weight average molecular weight of, for example, from about 500,000 to about 750,000. The carrier may include the polymer coating generated in admixture with other suitable polymers, and more specifically, with a second polymer, such as a fluoropolymer, polymethylmethacrylate, poly(urethane), especially a crosslinked polyurethane, such as a poly(urethane) polyester and the like, and moreover, the copolymer coating may contain a conductive component, such as carbon black, and which conductive component is preferably dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like.

Advantage associated with the carriers of the present invention include efficient carrier coating processes with substantially no exotherms on full scale up; a high triboelectrical charge, for example a carrier tribo range of from about a plus (positive charge) 25 to about 75, and preferably from about a positive 30 to about a positive 65 microcoulombs per gram. The carrier particles of the present invention can be selected for a number of different imaging systems and devices, such as xerographic copiers and printers, inclusive of high speed color xerographic systems, printers, digital systems, a combination of xerographic and digital systems, and wherein colored images with excellent and substantially no background deposits are achievable. Developer compositions comprised of the carrier particles illustrated herein are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

REFERENCES

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of about 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carriers containing a mixture of polymers, such as two polymers, not in close proximity in the triboelectric series. The appropriate components and processes of the '166 and '326 patents may be selected for the present invention in embodiments thereof.

Other U.S. patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY

It is a feature of the present disclosure to provide toner and developer compositions with carrier particles containing polymer coatings.

In another feature of the present disclosure there are provided coating processes for generating carrier particles of substantially constant conductivity parameters.

In yet another feature of the present disclosure there are provided coating processes for generating carrier particles of substantially constant conductivity parameters, and high triboelectric charging values.

Aspects of the present disclosure relate to a carrier comprised of a core and a polymer generated from a mixture of two latexes, and wherein the first latex comprises a first polymer with a high molecular weight and the second latex comprises a second polymer with a low molecular weight, and wherein high represents a weight average molecular weight of from about 2,000,000 to about 6,000,000 and said low represents a weight average molecular weight of from about 500,000 to about 800,000, such as from about 500,000 to about 600,000; a developer comprised of (1) a carrier core and polymer coating layer thereover, and (2) a toner; and wherein said coating is generated from a mixture of at least two latexes, wherein the first latex contains a monomer that subsequent to polymerization forms a first polymer with a high molecular weight, and a second latex that contains a monomer that subsequent to polymerization forms a second polymer with a low molecular weight; and wherein high represents a weight average molecular weight of from about 2,000,000 to about 10,000,000, for example from about 4,000,000 to about 10,000,000, such as from about 4,000,000 to about 5,000,000 or from about 4,000,000 to about 6,000,000 or from about 4,000,000 to about 7,000,000, and said low represents a weight average molecular weight of from about 400,000 to about 800,000; a process which comprises the mixing and heating of two latexes wherein one latex contains a first polymer resulting from the polymerization of a monomer, which first polymer possesses a weight average molecular weight of from about 1,000,000 to about 10,000,000, and wherein said second latex contains a second polymer resulting from the polymerization of a monomer, which second polymer possesses a weight average molecular weight of from about 400,000 to about 700,000; a carrier generated from a mixture of two latexes, one latex containing a first polymer with a high weight average molecular weight, such as from about 1,000,000 to about 10,000,000, and more specifically, from about 3,000,000 to about 6,000,000 million, and a second latex containing a second polymer with a low weight average molecular weight of from about 400,000 to about 700,000, and more specifically, from about 570,000 to about 650,000; a carrier wherein the polymer coating is a copolymer and the coating weight thereof is from about 0.1 to about 20 weight percent; a carrier wherein the polymer coating weight is from about 1 to about 3 weight percent; a carrier wherein the polymer coating contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a developer comprised of a coated carrier and toner; a developer wherein the toner is comprised of thermoplastic resin and colorant; a developer wherein the colorant is a pigment and the toner resin is a styrene copolymer, or a polyester; a developer comprised of (1) a carrier core and coating layer generated from two wet latexes as illustrated herein, and (2) a toner; a developer wherein the carrier core is selected from the group consisting of iron, ferrites, steel and nickel; a developer with a carrier triboelectric charge of from about 25 to about 75 microcoulombs per gram, and a toner triboelectric charge of from about a negative 20 to about a negative 80 microcoulombs per gram; a carrier having the above described polymer coating, wherein the carrier has a triboelectric charge of about positive 20; a carrier containing a third polymer in the polymer coating; a carrier wherein the third polymer in the polymer coating consists of a fluoropolymer, a polymethylmethacrylate, a polyurethane or a poly(urethane)polyester; a carrier wherein the third polymer in the polymer coating is a poly(urethane)polyester and which optionally contains dispersed therein conductive components; a process for generating a polymer coating which comprises the wet mixing of two latexes as illustrated herein followed by spray drying or freeze drying, and then thereafter powder coating of the resulting linear polymer; a process for the generation of a polymer coating from a mixture of first and second latexes, and wherein the first latex is comprised of a monomer, such as about 99:1 polymethylmethacrylate (MMA) and co-methacrylic acid (MMA), heating, adding a second portion of the monomer, heating until there results a polymer with a high molecular weight; and a second monomer latex, the same as the first latex except that the polymer generated has a low molecular weight as illustrated herein.

More specifically, in embodiments the first and second latexes are generated as follows:

The polymerization of these latexes occurs in the temperature range from about 50° C. to about 80° C. The polymerization of the latexes is accomplished by heating at an effective temperature such as from about 50° C. to about 80° C. For the polymerization, there are usually selected known initiators, such as radical initiators capable of initiating a free radical polymerization process. Examples of initiators include organic soluble free radical initiators, including organic peroxide initiators such as benzoyl peroxide and lauroyl peroxide, and azo initiators, such as azobisisobutyronitrile, and the like. The initiator concentration employed is, for example, from about 0.05 to about 5 weight percent of the total weight of monomer to be polymerized, and which amount is determined by the desired molecular weight of the resin. As the initiator concentration is decreased relative to the weight of molar equivalents of monomer used, the molecular weight of the thermoplastic resin product generally increases. Free radical initiators useful in the present invention include any free radical initiator that is capable of providing free radical species upon heating to above about 30° C.

Examples of water soluble free radical initiators or polymerization initiators that can be selected include those that are traditionally used in emulsion polymerization reactions and that provide a water soluble or polar phase compatible functional group upon reaction with the monomers. Examples of water soluble free radical initiators are persulfates, water soluble peroxides and hydroperoxides; more specifically, sodium, potassium and ammonium persulfates, hydrogen peroxide, t-butyl hydroperoxide, cumene hydroperoxide, para-menthane hydroperoxide, and peroxy carbonates. Other water soluble initiators of similar decomposition mechanism may be used if desired, for example azo compounds such as 4,4'-azobis(4-cyanovaleric acid); 1,1'-azobis(1-methylbutyronitrile-3-sodium sulfonate); 2,2'-azobis(2-amidinopropane)dihydrochloride; 2,2'-azobis(2-amidinopropane) dihydrochloride; 2,2'-azobis(2-amidinopropane)dihydrochloride; 2,2'-azobisisobutyl amide dihydrate; 2,2'-azobis[2-(2-imidazolin-2-yl)propane]dihydrochloride; and 2,2'-azobis[2-(5-methyl-2-imidazolin-2-yl-propane)]dihydrochloride.

Reactive monomers examples include unsaturated compounds that react with the free radical initiator compounds or propagating free radical species, and which monomers can be selected in various effective amounts, such as from about 1 to about 98 weight percent based on the total weight of polymerization reaction components. The monomer or monomers used are substantially water insoluble, generally hydrophobic, and can be readily dispersed in the formed aqueous phase with adequate stirring when added to the reaction vessel. The dispersal of the reactive monomers can be further enhanced and assisted by an in situ stabilization or oligosurfactant formation resulting from the free radical addition reaction of the water soluble initiator, such as persulfate, to the added reactive monomers. Optionally, anionic, nonionic or cationic surfactants may be used to assist the dispersion process.

The monomers, polymers and copolymers which may be selected may include such monomers, polymers or copolymers that are suitable for conventional emulsion polymerization processes; specific examples of monomers include, but are not limited to, those used for obtaining polymethylmethacrylate resins, styrene/acrylate resins, styrene/methacrylate resins and vinyl resins. Suitable homopolymer adjuncts of the base polymer resin would be vinyl resins including homopolymers or copolymers of one or more vinyl monomers. Typical examples of vinyl monomeric units include, but are not limited to, styrene, p-chlorostyrene, vinyl naphthalene, vinyl chloride, vinyl bromide, vinyl fluoride, ethylenically unsaturated monoolefins such as ethylene, propylene, butylene, isobutylene and the like; vinyl esters such as vinyl acetate, vinyl propionate, vinyl benzoate, vinyl butyrate, and the like; esters of alphamethylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; vinylidene halides such as vinylidene chloride, vinylidene chlorofluoride and the like; N-vinyl indole, N-vinyl pyrrolidene and the like; dienes, such as butadiene and isoprene and the like; and mixtures thereof.

The polymer resins generated may be characterized as having a molecular weight and a molecular weight distribution substantially anywhere within the $M_w$-$M_{WD}$ domain. For example, high molecular weight resins produced by the process of the present disclosure may have an $M_w$ of from about 800,000 to about 3,000,000, and preferably from about 1,500,000 to about 2,700,000. High molecular weight resins of the present disclosure further may have an $M_{WD}$ of from about 2 to about 100, and preferably from about 2 to about 20. The low molecular weight resins produced by the process of the present invention may have an $M_w$ of from about 400,000 to about 900,000, and preferably from about 500,000 to about 750,000. High molecular weight resins of the present disclosure further may have an $M_{WD}$ Of from about 2 to about 100, and preferably from about 2 to about 20. Resins produced by the present invention may also have a glass transition temperature (Tg) of from about 20° C. to about 150° C., and preferably from about 60° C. to about 125° C.

Also disclosed are developer compositions comprised of toner particles containing polymers or resins illustrated herein, and carrier particles prepared, for example, by a powder coating process, and wherein the carrier particles are comprised of a core with certain coatings thereover; carrier particles prepared by mixing low density porous magnetic, or magnetically attractable metal core carrier particles with from, for example, between about 0.05 percent and about 3 percent by weight, based on the weight of the coated carrier particles, of certain polymers, and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., more specifically about 400° C., for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide, and available from D.M. Steward Corporation or Powdertech Corporation, Ni/Zn-ferrite available from Powdertech Corporation, Sr (strontium)-ferrite, containing, for example, about 14 percent strontium oxide and 86 percent iron oxide, and available from Powdertech Corporation Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and preferably from about 35 to about 100 microns.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Various effective suitable processes can be selected to apply the polymer, or mixture, for example from about 2 to about 5, and preferably 2, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and more specifically, pigments including, for example, carbon black, nigrosine dye, lamp black, iron oxides, magnetites, and mixtures thereof, known cyan, magenta, yellow pigments, and dyes. The colorant, which can be carbon black, should be present in a sufficient amount to render the toner composition highly colored. Thus, the colorant can be present in amounts of, for example, from about 1 percent by weight to about 20 percent by weight, and more specifically from about 5 percent by weight to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15 weight percent, and, for example, from about 2 weight percent to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate, reference U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20 percent by weight, and, for example, from about 3 percent by weight to about 12 percent by weight. These charge additives can also be dispersed in the carrier polymer coating as indicated herein.

The toner compositions can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particle sizes and shapes are known and include, for example, a toner size of from about 2 to about 25, and more specifically from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus usually requiring a positively charged toner.

Images, especially colored images, obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

SYNTHETIC EXAMPLE I

Latex One—$M_w$ of ~700,000:

A latex copolymer comprised of methyl methacrylate (MMA)/methacrylic acid (MAA) of 99/1 parts (by weight throughout unless otherwise indicated) was prepared by a "seed and growth" emulsion polymerization process as follows:

An 8 liter jacketed glass reactor was fitted with a stainless steel semi-helical stirrer, thermal couple temperature probe, water cooled condenser with nitrogen outlet, a nitrogen inlet, internal cooling capabilities, and hot water circulating bath. After reaching a jacket temperature of 70° C.+/−1° C. and a continuous nitrogen purge, the reactor was charged with 3,827.3 grams of distilled water and 7.65 grams of the anionic surfactant sodium dodecyl sulfate (available from Aldrich Chemicals). The stirrer was then set at 230 RPM and maintained at this speed for 30 minutes after which the speed was reduced to 180 RPM and the reactor contents controlled at 65° C.+/−1° C. by the internal cooling system. In a holding vessel, a monomer mixture comprised of methyl methacrylate (MMA)/methacrylic acid (MAA) of 99/1 parts was prepared with 1,130.78 grams of MMA (as received) and 11.42 grams of methacrylic acid (as received) for a total of 1,142.20 grams. About 10 percent of the total monomer, ~114 grams, was then charged into the reactor and stirred at 180 RPM for about 10 minutes. At this time a solution of 4.57 grams of ammonium persulfate (APS) and 18.28 grams of distilled water were rapidly injected to initiate polymerization. In about 30 seconds, the evidence of polymerization and seed formation was verified by a hazy appearance. In about 8 minutes after initiation, the remainder of the monomer mix was pumped into the reactor at a rate of about 8 grams per minute or for a total monomer feed time of about 128 minutes. The emulsion polymerization was then allowed to further stir at 180 RPM and 65° C.+/−1° C. for an additional 120 minutes to complete conversion of monomer. The reactor and contents was then cooled to about 25° C. and the resulting latex removed. A fine powdered sample of copolymer product was isolated by freeze-drying techniques.

Molecular weight ($M_w$) was determined by gel permeation chromatography to be 734,000, with $M_{WD}$=2.5. The resulting copolymer was found to have a glass transition of 117.5° C. as measured on a Seiko DSC. Acid number was 9.5 milligrams KOH/g as determined by titration with methanolic sodium hydroxide. Size of the latex particles produced were measured by a Honeywell Microtrac UPA 150 and observed to be about 78 nanometers.

SYNTHETIC EXAMPLE II

Latex Two:

A latex copolymer comprised of methyl methacrylate (MMA)/methacrylic acid (MAA) of 99/1 parts (by weight throughout unless otherwise indicated) was prepared by a "seed and growth" emulsion polymerization process as follows:

An 2 liter jacketed glass reactor was fitted with a stainless steel semi-helical stirrer, thermal couple temperature probe, water cooled condenser with nitrogen outlet, a nitrogen inlet, internal cooling capabilities, and hot water circulating bath. After reaching a jacket temperature of 70° C.+/−1° C. and continuous nitrogen purge, the reactor was charged with 1,008.9 grams of distilled water and 2.01 grams of the anionic surfactant sodium dodecyl sulfate (available from Aldrich Chemicals). The stirrer was then set at 140 RPM and maintained at this speed for 30 minutes, and the reactor contents controlled at 65° C.+/−1° C. by the internal cooling system. In a holding vessel, a monomer mixture comprised of methyl methacrylate (MMA)/methacrylic acid (MAA) of 99/1 parts was prepared with 297.01 grams of MMA (as received) and 3 grams of methacrylic acid (as received) for a total of 300.01 grams. About 10 percent of the total monomer, about 30 grams, was then charged into the reactor and stirred at 140 RPM for about 7 minutes. At this time, a solution of 0.30 gram of ammonium persulfate (APS) and 1.20 grams of distilled water were rapidly injected to initiate polymerization. In about 30 seconds, the evidence of polymerization and seed formation is verified by a hazy appearance. In about 8 minutes after initiation, the remainder of the monomer mix was pumped into the reactor at a rate of about 2.10 grams per minute or for a total monomer feed time of about 128 minutes. The emulsion polymerization was then allowed to further stir at 140 RPM and 65° C.+/−1° C. for an additional 120 minutes to complete conversion of monomer. The reactor and contents was then cooled to about 25° C. and the resulting latex removed. A fine powdered sample of copolymer product was isolated by freeze-drying techniques.

Molecular weight ($M_w$) was determined by gel permeation chromatography to be 5,289,000 with $M_{WD}$=2.2. The resulting copolymer was found to have a glass transition of 122.3° C. as measured on a Seiko DSC. Acid number was 10.1 milligrams KOH/g as determined by titration with methanolic sodium hydroxide. Size of the latex particles produced was measured by a Honeywell Microtrac UPA 150 and observed to be about 111 nanometers.

EXAMPLE III

Preparation of a Two Latex Powder Carrier Coating:

The latexes one and two generated by the processes of Examples I and II were mixed at suitable ratios to provide an excellent coating and high durability. The latex powder can be produced by mixing the two polymers to obtain the desired ratio of high molecular weight polymer to low molecular weight polymer. The ratio ranges preferred are about 20 to about 80 low molecular weight to high molecular weight, and most specifically about 40 to about 60 low molecular weight to high molecular weight. Drying of the polymer mixes can be completed by either freeze or spray drying. The carrier product resulting possesses excellent coating adhesion to the core particle and excellent durability. Tribo and conductivity should have similar ranges to those of the lower molecular weight carrier coating. These carrier materials had on average a tribo of 33 μc/gram and an average conductivity of $10^{-11}$ $(\text{ohm-cm})^2$.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A carrier comprised of a core and a polymer coating generated from a mixture of two latexes, and wherein the first latex comprises a first polymer with a high molecular weight and the second latex comprises a second polymer with a low molecular weight, and wherein said high molecular weight represents a weight average molecular weight of from about 4,000,000 to about 10,000,000 and said low molecular weight represents a weight average molecular weight of from about 500,000 to about 750,000.

2. A carrier in accordance with claim 1 wherein said high molecular weight is from about 4,000,000 to about 6,000,000, and said low molecular weight is from about 500,000 to about 600,000.

3. A carrier in accordance with claim 1 wherein said high molecular weight is from about 4,000,000 to about 5,000,000, and said low molecular weight is from about 500,000 to about 650,000.

4. A carrier in accordance with claim 1 wherein said high molecular weight is from about 4,000,000 to about 7,000,000, and said low molecular weight is from about 550,000 to about 650,000.

5. A carrier in accordance with claim 1 wherein said high molecular weight is from about 4,000,000 to about 5,000,000, and said low molecular weight is from about 500,000 to about 600,000.

6. A carrier in accordance with claim 1 wherein a coating weight of the polymer coating is from about 0.1 to about 20 weight percent.

7. A carrier in accordance with claim 6 wherein the coating weight of the polymer coating is from about 1 to about 3 weight percent.

8. A carrier in accordance with claim 1 wherein the polymer coating contains a conductive component.

9. A carrier in accordance with claim 8 wherein said conductive component is a metal oxide, or carbon black.

10. A carrier in accordance with claim 8 wherein said conductive component is carbon black selected in an amount of from about 10 to about 60 weight percent.

11. A carrier in accordance with claim 1 wherein said core is a metal, a metal oxide, or a ferrite.

12. A carrier in accordance with claim 1 with a triboelectric charge of about a positive 20 microcoulombs per gram.

13. A developer comprised of the carrier of claim 1 and toner.

14. A developer in accordance with claim 13 wherein the toner is comprised of thermoplastic resin and colorant.

15. A developer in accordance with claim 14 wherein the colorant is a pigment and the resin is a styrene copolymer, or a polyester.

16. A carrier in accordance with claim 1 wherein the polymer coating comprises a third polymer.

17. A carrier in accordance with claim 16 wherein the third polymer consists a fluoropolymer, a polymethylmethacrylate, a polyurethane or a poly(urethane)polyester.

18. A carrier in accordance with claim 16 wherein the third polymer is a poly(urethane)polyester with carbon black optionally dispersed therein.

19. A process for the preparation of the carrier of claim 1 comprising dry mixing and heating said core and said polymer coating.

20. A carrier in accordance with claim 1 wherein at least one of said first polymer and said second polymer is a polymethylmethacrylate co-methacrylic acid copolymer.

21. A carrier in accordance with claim 1 wherein at least one of said first polymer and said second polymer is a polymethylmethacrylate co-methacrylic acid copolymer, and wherein a ratio of said polymethylmethacrylate to said acid copolymer is about 99:1 by weight.

22. A developer comprised of (1) a carrier core and polymer coating layer thereover, and (2) a toner; and wherein said coating is generated from a mixture of at least two latexes, wherein the first latex comprises a first polymer with a high molecular weight, and a second latex comprises a second polymer with a low molecular weight; and wherein said high molecular weight represents a weight average molecular weight of from about 4,000,000 to about 10,000,000, and said low molecular weight represents a weight average molecular weight of from about 400,000 to about 800,000.

23. A developer in accordance with claim 22 wherein the carrier core is selected from the group consisting of iron, ferrites, and steel.

24. An imaging process which comprises developing an image with the developer of claim 22.

25. A process for forming a carrier comprised of a core and a polymer coating, comprising mixing and heating of two latexes to form a polymer mix;

wherein one latex contains a polymer resulting from the polymerization of a monomer, which polymer possesses a weight average molecular weight of from about 4,000,000 to about 10,000,000, and wherein said second latex contains a polymer resulting from the polymerization of a monomer, which polymer possesses a weight average molecular weight of from about 400,000 to about 700,000;

drying the polymer mix by spray drying or freeze drying; and coating core particles with the polymer mix, and heating said polymer mix coated core particles, to form a carrier.

* * * * *